US009670715B2

(12) United States Patent
Hosaka

(10) Patent No.: US 9,670,715 B2
(45) Date of Patent: Jun. 6, 2017

(54) FIRE DOOR

(71) Applicant: Daifuku Co., Ltd., Osaka-shi (JP)

(72) Inventor: Yoshihiro Hosaka, Komaki (JP)

(73) Assignee: Daifuku Co., Ltd., Osaka-shi (JP)

( * ) Notice: Subject to any disclaimer, the term of this patent is extended or adjusted under 35 U.S.C. 154(b) by 0 days.

(21) Appl. No.: 15/159,923

(22) Filed: May 20, 2016

(65) Prior Publication Data

US 2016/0340966 A1 Nov. 24, 2016

(30) Foreign Application Priority Data

May 21, 2015 (JP) ..... 2015-103823

(51) Int. Cl.
*E05F 11/34* (2006.01)
*E06B 5/16* (2006.01)
*E05D 15/06* (2006.01)

(52) U.S. Cl.
CPC ..... *E06B 5/167* (2013.01); *E05D 15/063* (2013.01); *E05D 15/0656* (2013.01); *E06B 5/161* (2013.01); *E05Y 2900/134* (2013.01)

(58) Field of Classification Search
CPC ..... E06B 5/167; E06B 5/161; E05D 15/063; E05D 15/0656; E05Y 2900/134
USPC ..... 49/362, 226, 227, 228, 231
See application file for complete search history.

(56) References Cited

U.S. PATENT DOCUMENTS 380,690 A * 4/1888 Peirce ..... 405/103
1,480,453 A * 1/1924 Lane ..... E05D 13/06 49/119
4,457,106 A * 7/1984 Forquer ..... E06B 9/04 160/197
5,893,242 A * 4/1999 Perron ..... E05F 11/36 49/360
6,021,608 A * 2/2000 Ollison ..... E05B 65/08 292/67
6,658,793 B2 * 12/2003 Perron ..... E05F 11/04 49/123
2006/0048466 A1 * 3/2006 Darnell ..... E06B 1/32 52/204.1

(Continued)

FOREIGN PATENT DOCUMENTS

FR 2664644 A1 * 1/1992 ..... E05F 15/635
JP 7176587 A 7/1995

*Primary Examiner* — Jerry Redman
(74) *Attorney, Agent, or Firm* — The Webb Law Firm

(57) ABSTRACT

A door body includes a door main body, an upper guided portion provided to an upper portion of the door main body, and a lower guided portion provided to a lower portion of the door main body. A guide member includes an upper guide portion, a lower guide portion, and a restricting portion. The upper guide portion supports the upper guided portion from below while restricting movement of the upper guided portion along the fore and aft direction. The lower guide portion supports the lower guided portion from below while restricting movement of the lower guided portion along the fore and aft direction. The upper guided portion is moved upwardly away from the upper guide portion in the expanded support state. The restricting portion restricts movement of the door main body in the first direction in the expanded support state, and restricts movement of the door main body in the second direction in the expanded support state.

6 Claims, 3 Drawing Sheets

(56) References Cited

U.S. PATENT DOCUMENTS

| | | | | |
|---|---|---|---|---|
| 2008/0092330 | A1* | 4/2008 | Haab | E05D 15/0634 16/98 |
| 2011/0132698 | A1* | 6/2011 | Yu | B66B 13/30 187/333 |
| 2013/0227891 | A1* | 9/2013 | Cox | E06B 5/167 49/394 |

* cited by examiner

FIRE DOOR

CROSS-REFERENCE TO RELATED APPLICATION

This application claims priority to Japanese Patent Application No. 2015-103823 filed May 21, 2015, the disclosure of which is hereby incorporated in its entirety by reference.

FIELD OF THE INVENTION

The present invention relates to a fire door comprising a plate-shaped door body movable from an open position at which an opening is open to a closed position at which the opening is closed by the door body, and a guide member for guiding movement of the door body, wherein the door body is disposed in an attitude in which the door body extends along a vertical direction of the opening and along a lateral direction of the opening, the door body being movable along the lateral direction from the open position to the closed position.

BACKGROUND

An example of such fire doors is described in JP Publication of Application No. H7-176587 (Patent Document 1). Patent Document 1 is described using the terms and reference numerals (in parentheses) used in Patent Document 1. In the fire door (1*a*) of Patent Document 1, an automatically opening and closing door (16), which functions as a door body, has upper spacers (12) provided to an upper portion of the automatically opening and closing door (16), and lower spacers (12) provided to a lower portion of the automatically opening and closing door (16). The upper spacers (12) engage a slide pack (11) so as to be smoothly guided along a lateral direction while preventing their movements along the vertical and fore and aft directions. The lower spacers (12) engage a linear guide (13) so as to be smoothly guided along the lateral direction while preventing their movements along the vertical and fore and aft directions.

With the fire door of Patent Document 1, the fire door is moved from its open position to its closed position to close the opening, when a fire breaks out, to prevent the flames, smoke, and hot air generated by the fire from passing through the opening.

SUMMARY OF THE INVENTION

In the fire door of Patent Document 1, the automatically opening and closing door 16 expands from being heated by the heat from the fire. As the automatically opening and closing door 16 expands along the vertical direction, the vertical distance, between the upper spacers 12 provided to the upper portion of the automatically opening and closing door 16 and the lower spacers 12 provided to the lower portion of the automatically opening and closing door 16, increases. Thus, in the fire door of Patent Document 1, stress is generated that tend to be concentrated on areas in which the upper spacers 12 engage the slide pack 11, and areas in which the lower spacers 12 engage the liner guide 13. This has lead to the possibility of the upper or/and lower spacers 12 being damaged to the point where the upper spacers 12 disengage from the slide pack 11, and/or, the lower spacers 12 disengage from the linear guide 13. When they disengage, movements of the upper portion and/or lower portion of the automatically opening and closing door 16 along the fore and aft direction are no longer prevented, greatly reducing the strength of the fire door.

Thus, a fire door is desired in which damage to the door body caused by the door body expanding due to heat from a fire is prevented and in which reduction in strength of the door body can be alleviated by restricting movement of the door body along the fore and aft direction.

The characteristic arrangement of a fire door in light of the above is that the fire door comprises: a plate-shaped door body movable from an open position at which an opening is open to a closed position at which the opening is closed by the door body; a guide member for guiding movement of the door body; wherein the door body is disposed in an attitude in which the door body extends along a vertical direction of the opening and along a lateral direction of the opening, the door body being movable along the lateral direction from the open position to the closed position, wherein, with a direction perpendicular to the lateral direction as seen along the vertical direction being defined as a fore and aft direction, the door body includes a door main body, an upper guided portion provided to an upper portion of the door main body, and a lower guided portion provided to a lower portion of the door main body; wherein the guide member includes an upper guide portion for guiding the upper guided portion along the lateral direction, a lower guide portion for guiding the lower guided portion along the lateral direction, and a restricting portion for restricting movement of the door main body along the fore and aft direction, wherein the upper guide portion supports the upper guided portion from below while restricting movement of the upper guided portion along the fore and aft direction, wherein the lower guide portion supports the lower guided portion from below while restricting movement of the lower guided portion along the fore and aft direction, wherein the door body is so dimensioned that the upper guided portion is moved upwardly away from the upper guide portion when in an expanded support state in which the lower guide portion is supporting the lower guided portion from below and in which the door main body has expanded from an initial form due to heat from a fire, wherein the restricting portion includes a first restricting portion and a second restricting portion, wherein, with one direction along the fore and aft direction being defined as a first direction and a direction along the fore and aft direction that is opposite from the first direction being defined as a second direction, the first restricting portion includes a first contact portion which overlaps with an upper end portion of the door main body as seen along the fore and aft direction when in the expanded support state, wherein, when in the expanded support state, the first contact portion restricts movement of the door main body in the first direction by coming into contact with a surface of the upper end portion of the door main body that faces in the first direction, wherein the second restricting portion includes a second contact portion which overlaps with an upper end portion of the door main body as seen along the fore and aft direction when in the expanded support state, and wherein, when in the expanded support state, the second contact portion restricts movement of the door main body in the second direction by coming into contact with a surface of the upper end portion of the door main body that faces in the second direction.

As such, when moving the door body along the lateral direction to move it from the open position to the closed position, both the upper portion and the lower portion of the door main body can be guided by the upper guided portion provided to the upper portion of the door main body and the lower guided portion provided to the lower portion of the door main body, thus allowing the door main body to be moved smoothly.

When the door main body expands from the initial form due to heat from a fire, the distance along the vertical direction between the upper guided portion and the lower guided portion increases due to this thermal expansion. When this happens, because the upper guided portion is moved upwardly away from the upper guide portion while the lower guided portion remains supported from below by the lower guide portion, stress is prevented from concentrating on the upper guided portion and the lower guided portion, thus, preventing the upper guided portion and/or the lower guided portion from being damaged.

In addition, although the upper guided portion is moved upwardly away from the upper guide portion in the expanded support state, movement of the upper end portion of the door main body in the first direction along the fore and aft direction can be restricted by the first contact portion of the first restricting portion of the restricting portion whereas movement of the upper end portion of the door main body in the second direction along the fore and aft direction can be restricted by the second contact portion of the second restricting portion of the restricting portion. In other words, in the expanded support state, and in the lower portion of the door main body, movement of the lower guided portion along the fore and aft direction can be restricted by the lower guide portion while supporting the lower guided portion from below, whereas, in the upper portion of the door main body, movement of the door main body itself along the fore and aft direction can be restricted by the restricting portion. Therefore, damage to the door body caused by the door body expanding due to heat from a fire can be prevented. And reduction in strength of the door body can be alleviated by restricting movement of the door body along the fore and aft direction.

DETAILED DESCRIPTION OF THE EMBODIMENTS

Embodiments of an article transport facility having a fire door of the present invention are described next with reference to the accompanying drawings.

Figure 1:
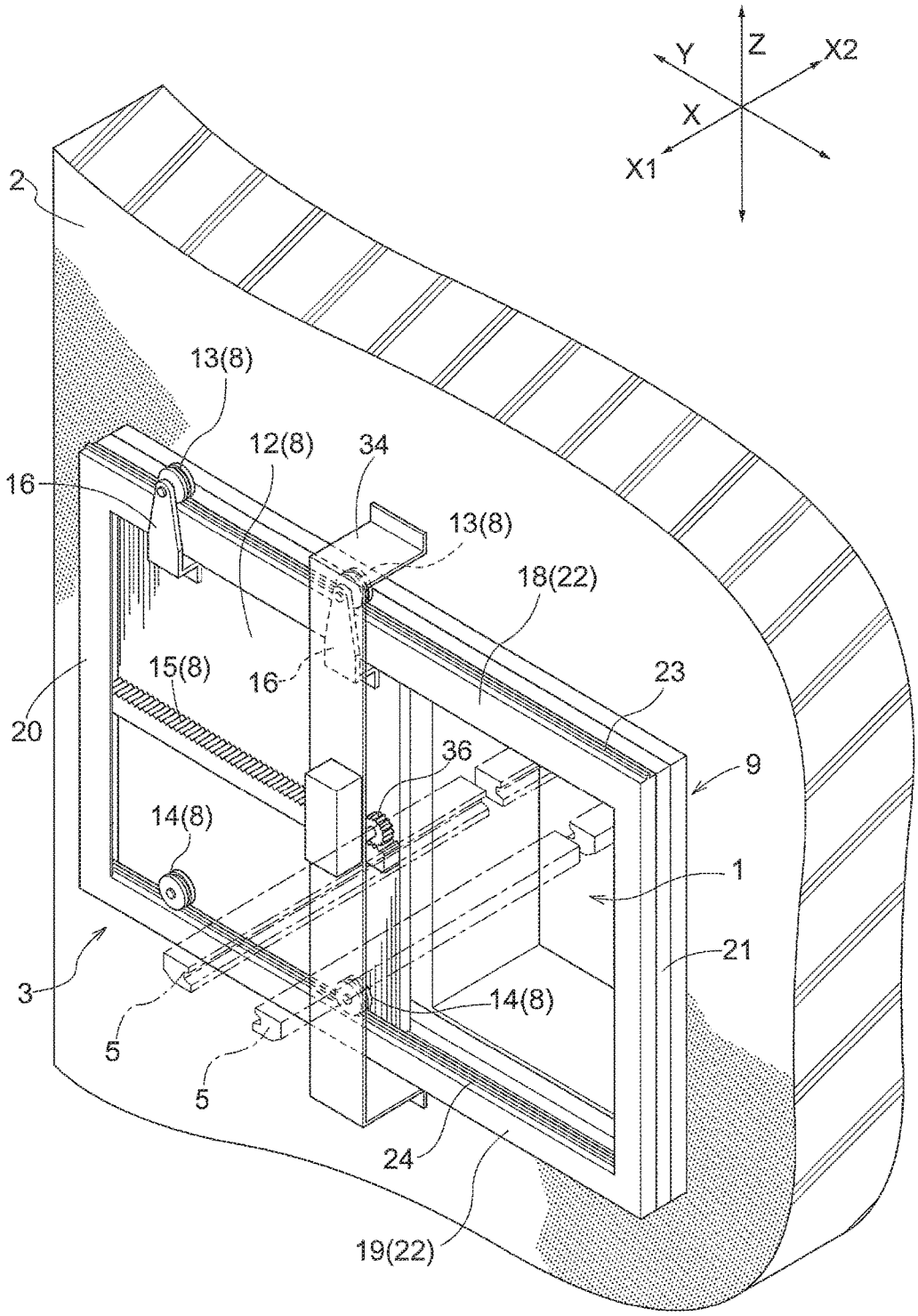
FIG. 1 is a perspective view of a fire door.
Figure 2:
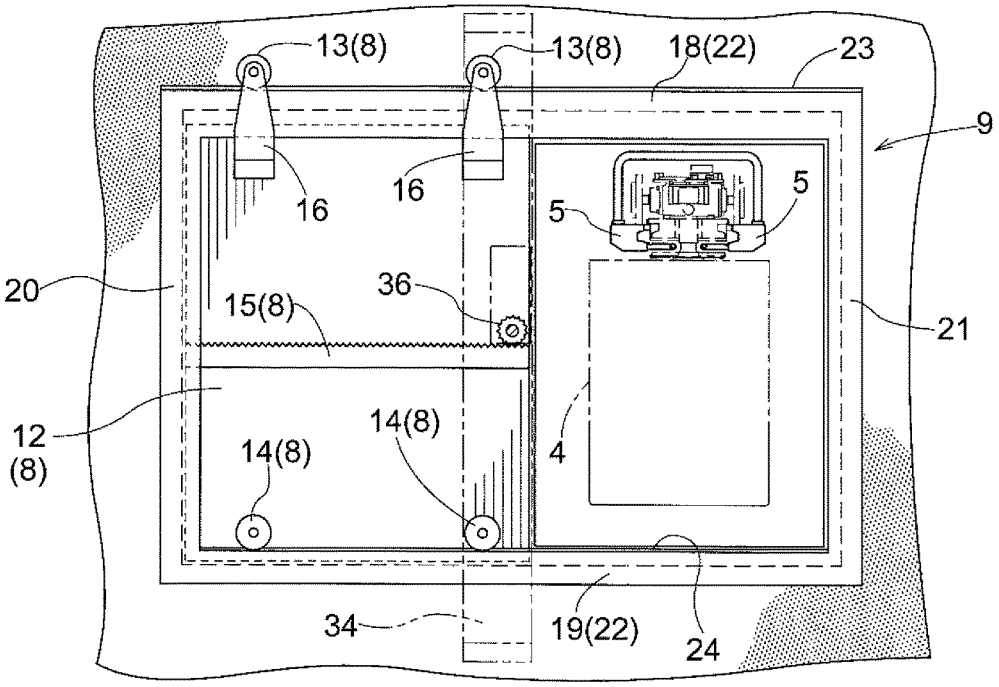
FIG. 2 is a front view of the fire door when a door body is in an open position.

As shown in FIGS. 1 and 2, there are provided a wall 2 in which an opening 1 is formed, a fire door 3 for opening and closing the opening 1, and travel rails 5 for supporting and guiding a ceiling or overhead transport vehicle 4 along a travel path (see FIG. 2).

Figure 3:
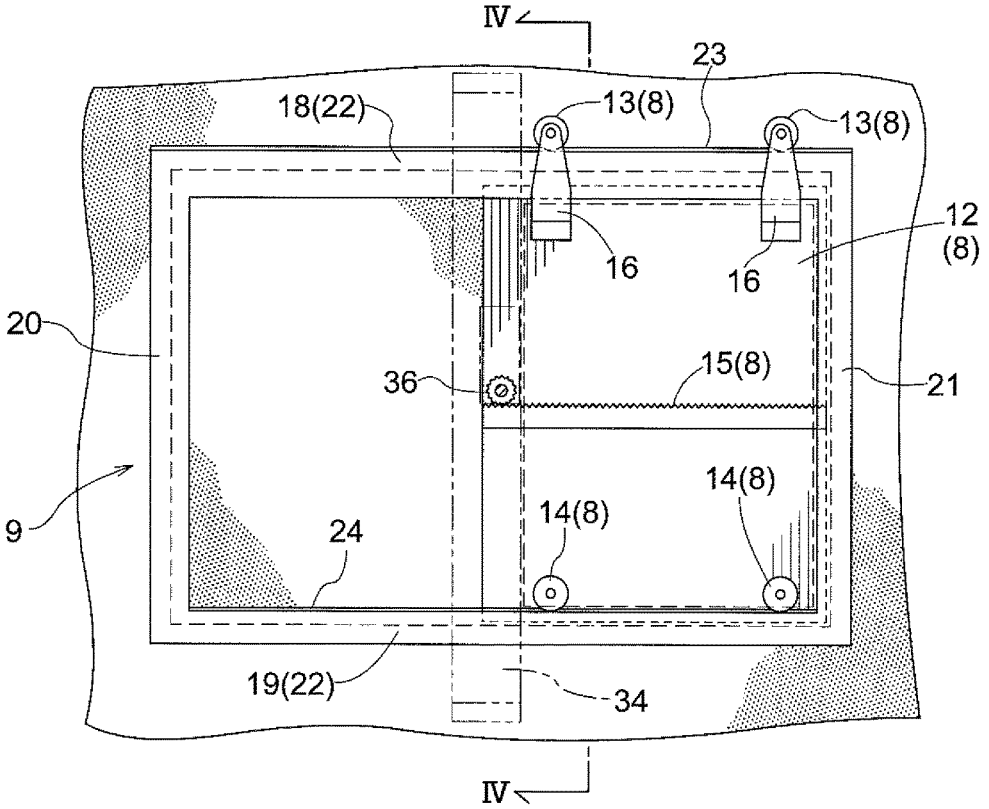
FIG. 3 is a front view of the fire door when the door body is in a closed position.

Note that, in the following description, the fore and aft direction X (see FIG. 1) is defined to be a direction perpendicular to the lateral direction Y of the opening 1 as seen along a vertical direction Z (i.e., the horizontal direction along the plane of the opening). In addition, one direction along the fore and aft direction X (i.e., the direction in which the fire door 3 exists relative to the wall 2) is defined as the first direction X1, whereas the other direction along the fore and aft direction X (i.e., the direction in which the wall 2 exists relative to the fire door 3) is defined as the second direction X2. In addition, in the description, one direction (toward the right in FIGS. 2 and 3) along the lateral direction Y is defined as the closing direction whereas the other direction (toward the left in FIGS. 2 and 3) along the lateral direction Y is defined as the opening direction.

The travel rails 5 are installed near the ceiling to extend through the opening 1, and are installed such that portions of the travel rails 5 span between an area on the first direction side of the wall 2 along the fore and aft direction X and an area on the second direction side of the wall 2 along the fore and aft direction X. The ceiling transport vehicle 4 is configured to travel along the travel rails 5 and through the opening 1 along the fore and aft direction X to transport articles one article at a time.

The fire door 3 includes a plate-shaped (i.e., generally flat and thin) door body 8 which can be moved from its open position (position of the door body 8 in FIGS. 1 and 2) at which the opening 1 is open and to its closed position (position of the door body 8 in FIG. 3) at which the opening 1 is closed by the door body 8 and vice versa, a guide member 9 for guiding the movement of the door body 8, and an actuator device 10 for moving the door body 8 from the closed position to the open position and vice versa. The door body 8 is arranged in an attitude in which it extends along the vertical direction Z and along the lateral direction Y and is moved from the open position to the closed position along the lateral direction Y to close the opening 1 when a fire breaks out.

The door body 8 is configured to be moved from the open position to the closed position by causing it to slide in the closing direction and to be moved from the closed position to the open position by causing it to slide in the opening direction. The door body 8 includes a door main body 12, upper guide rollers 13 that function as an upper guided portion provided to an upper portion of the door main body 12, lower guide rollers 14 that function as a lower guided portion provided to a lower portion of the door main body 12, and a rack 15 provided on a vertically intermediate portion of the door main body 12. Each of the upper guide rollers 13 and the lower guide rollers 14 is a guide roller which is rotatable about an axis extending along the fore and aft direction X.

Each upper guide roller 13 is provided to the upper portion of the door main body 12 with the upper guide roller 13 connected to the upper portion of the door main body 12 through a connecting member 16.

The lower end portion of the connecting member 16 is connected to a surface of the door main body 12 that faces in the first direction Xl. Each upper guide roller 13 is rotatably connected to an upper end portion of the connecting member 16 for rotation about the pivot axis extending along the fore and aft direction X. Each upper guide roller 13 is located at a higher position than the door main body 12. In addition, each upper guide roller 13 is displaced in the first direction X1 relative to the door main body 12 in plan view.

A pair of connecting members 16 are connected to the upper end portion of the door main body 12 such that the connecting members 16 are spaced apart from each other along the lateral direction Y. And each upper guide roller 13 is connected to the corresponding one of the pair of connecting members 16. In other words, the pair of upper guide rollers 13 are connected to the upper portion of the door main body 12 through respective connecting members 16 such that the guide rollers 13 are spaced apart from each other along the lateral direction Y.

Each lower guide roller 14 is provided to the lower portion of the door main body 12 with the lower guide roller 14 connected directly (through its axis) to the surface of the door main body 12 that faces in the first direction Xl.

Each lower guide roller 14 is connected to the lower portion of the door main body 12 for rotation about the corresponding axis extending along the fore and aft direction X. Each lower guide roller 14 is located above the lower end of the door main body 12, and at a position at which the lower guide roller 14 overlaps with the lower portion of the door main body 12 as seen along the fore and aft direction X. In addition, each lower guide roller 14 is located on the first direction side of the door main body 12. A pair of lower guide rollers 14 are connected to the lower portion of the door main body 12 such that the guide rollers 14 are spaced apart from each other along the lateral direction Y.

Figure 4:
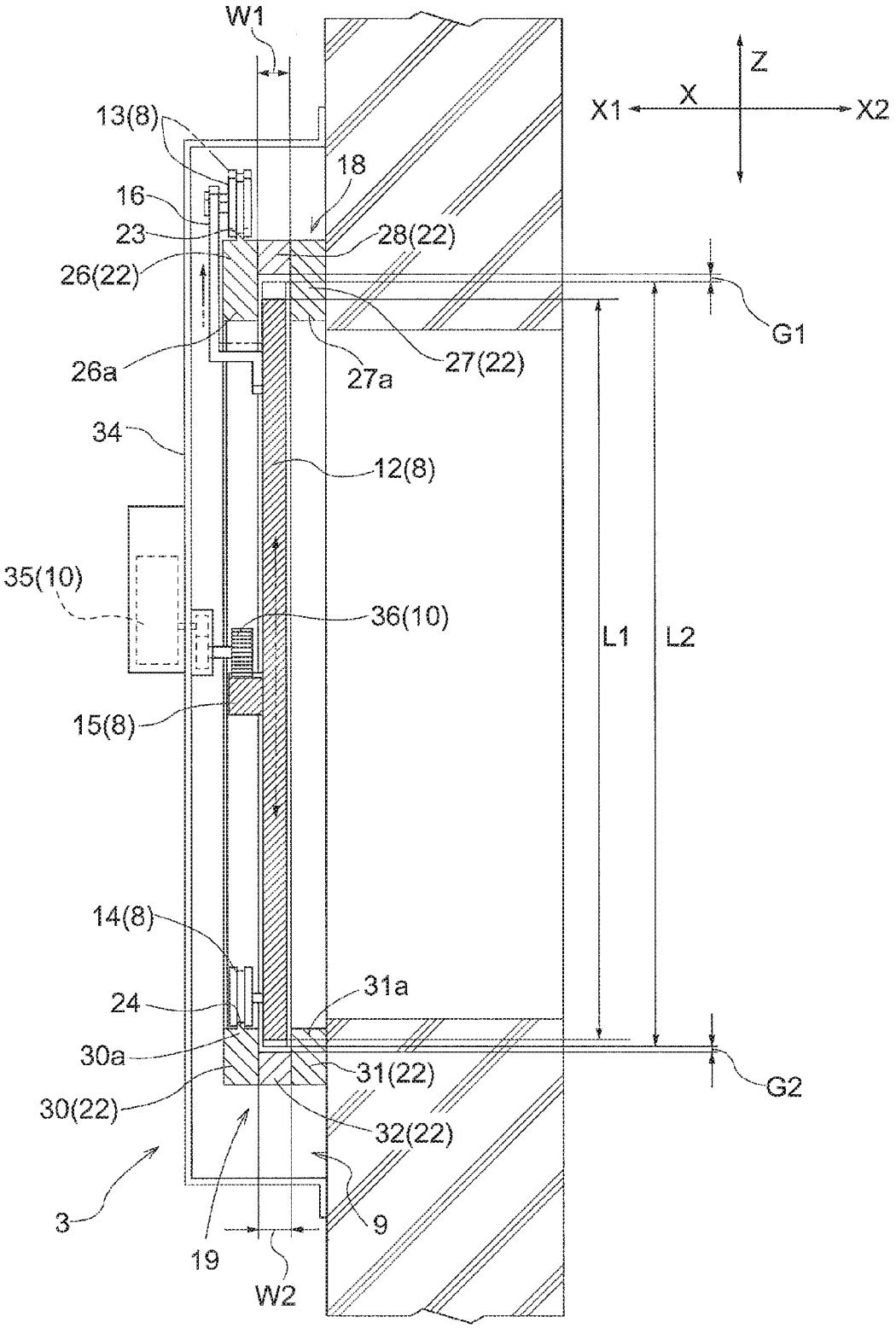
FIG. 4 is a vertical sectional side view of the fire door taken along line IV-IV in FIG. 3.

As shown in FIG. 4, a state in which a lower frame portion 19 is supporting the lower guide rollers 14 from below and in which the door main body 12 is in its initial form (i.e., a form (which is defined to take dimensions into consideration) in which the length of the door main body 12 along the vertical direction Z is L1 in FIG. 4) is defined to be an initial support state. In addition, as shown in FIG. 4 with phantom lines, a state in which a lower frame portion 19 is supporting the lower guide rollers 14 from below and in which the door main body 12 has a form that has expanded from the initial form due to heat from a fire (i.e., an expanded form, which is a form in which the length of the door main body 12 along the vertical direction Z is L2 in FIG. 4) is defined to be an expanded support state.

Incidentally, the initial form of the door main body 12 is a form of the door main body 12 in a normal temperature environment (in which the temperature is, for example, 20 degrees C.). In addition, the expanded form of the door main body 12 includes a form in which the door main body 12 has expanded from the initial form due to heat applied in an acceptance testing (to see certain specification requirements are met) of the fire door 3 (for example, a JIS acceptance testing, a UL (Underwriters Laboratories) standards acceptance testing, etc.), in addition to a form in which the door main body 12 has expanded from its initial form due to the heat of a fire that has actually broke out.

The guide member 9 includes an upper frame portion 18 located on an upper side along the vertical direction Z relative to the door main body 12, a lower frame portion 19 located on a lower side along the vertical direction Z relative to the door main body 12, a left frame portion 20 located on the opening direction side along the lateral direction Y relative to the door main body 12, and a right frame portion 21 located on the closing direction side along the lateral direction Y relative to the door main body 12. The guide member 9 is formed in a rectangular shape, as seen along the fore and aft direction X, by the four frame portions, namely, the upper frame portions 18, the lower frame portion 19, the left frame portion 20, and the right frame portion 21. And the upper frame portion 18 and the lower frame portion 19 form a restricting portion 22 for restricting the movement of the door main body 12 along the fore and aft direction X.

As shown in FIG. 4, the upper frame portion 18 is formed to have an U-shape with sharp corners (or a bracket shape) that opens downward as seen along the lateral direction Y whereas the lower frame portion 19 is formed to have a U-shape with sharp corners (or a bracket shape) that opens upward as seen along the lateral direction Y. While not shown, the left frame portion 20 is formed to have a U-shape with sharp corners (or a bracket shape) that opens to the right as seen along the vertical direction Z whereas the right frame portion 21 is formed to have a U-shape with sharp corners (or a bracket shape) that opens to the left as seen along the vertical direction Z.

An upper guide rail 23 is installed along the lateral direction Y and on the top surface of the upper frame portion 18. The upper frame portion 18 supports the upper guide rollers 13 from below with the upper guide rail 23 engaging or contacting the upper guide rollers 13 from below. Therefore, when the upper guide rollers 13 are supported by the upper frame portion 18, the upper guide rollers 13 are restricted from moving along the fore and aft direction X by the upper guide rail 23.

Thus, the upper frame portion 18 supports the upper guide rollers 13 from below while restricting the movement of the upper guide rollers 13 along the fore and aft direction X, and thus functions as an upper guide portion for guiding the upper guide rollers 13 along the lateral direction Y.

In addition, a lower guide rail 24 is installed along the lateral direction Y and on the top surface of the lower frame portion 19. The lower frame portion 19 supports the lower guide rollers 14 from below while restricting the movement of the lower guide rollers 14 along the fore and aft direction X, and thus functions as a lower guide portion for guiding the lower guide rollers 14 along the lateral direction Y, in a similar fashion to the case of the upper frame portion 18.

As shown in FIG. 4, the upper frame portion 18 includes a first restricting portion 26, a second restricting portion 27, and a first connecting portion 28. The first restricting portion 26 is located on the first direction X1 side, along the fore and aft direction X, of the door main body 12. The second restricting portion 27 is located on the second direction X2 side, along the fore and aft direction X, of the door main body 12. The first connecting portion 28 is located above the door main body 12 to connect the first restricting portion 26 and the second restricting portion 27 to each other. The upper frame portion 18 is formed in the shape of a U with sharp corners (or a bracket shape) that opens downward as seen along the lateral direction Y, by the first restricting portion 26, the second restricting portion 27, and the first connecting portion 28. The upper guide rail 23 is installed on the top surface of the first restricting portion 26 so that the upper guide rollers 13 are supported from below by the first restricting portion 26.

The first restricting portion 26 includes a first contact portion **26*a* which overlaps with an upper end portion of the door main body 12 in the expanded support state as seen along the fore and aft direction X. The first contact portion 26*a* overlaps with the upper end portion of the door main body 12 also in the initial support state as seen along the fore and aft direction X. Thus, the first contact portion 26*a* overlaps with the upper end portion of the door main body 12** both in the expanded support state and in the initial support state as seen along the fore and aft direction X.

The second restricting portion 27 includes a second contact portion **27*a* which overlaps with the upper end portion of the door main body 12 in the expanded support state as seen along the fore and aft direction X. The second contact portion 27*a* overlaps with the upper end portion of the door main body 12 both in the expanded support state and in the initial support state as seen along the fore and aft direction X, as in the case of the first contact portion 26*a***.

The lower frame portion 19 includes a third restricting portion 30, a fourth restricting portion 31, and a second connecting portion 32. The third restricting portion 30 is located on the first direction X1 side, along the fore and aft direction X, of the door main body 12. The fourth restricting portion 31 is located on the second direction X2 side, along the fore and aft direction X, of the door main body 12. The second connecting portion 32 is located below the door main body 12 to connect the third restricting portion 30 and the fourth restricting portion 31 to each other. The lower frame portion 19 is formed in the shape of a U with sharp corners (or a bracket shape) that opens upward as seen along the lateral direction Y, by the third restricting portion 30, the fourth restricting portion 31, and the second connecting portion 32. The lower guide rail 24 is installed on the top surface of the third restricting portion 30 so that the lower guide rollers 14 are supported from below by the third restricting portion 30.

The third restricting portion 30 includes a third contact portion 30*a* which overlaps with a lower end portion of the door main body 12 in the expanded support state as seen along the fore and aft direction X. In addition, the third contact portion 30*a* overlaps with the lower end portion of the door main body 12 also in the initial support state as seen along the fore and aft direction X. Thus, the third contact portion 30*a* overlaps with the lower end portion of the door main body 12 both in the expanded support state and in the initial support state as seen along the fore and aft direction X.

The fourth restricting portion 31 includes a fourth contact portion 31*a* which overlaps with the lower end portion of the door main body 12 in the expanded support state as seen along the fore and aft direction X. The fourth contact portion 31*a* overlaps with the lower end portion of the door main body 12 both in the expanded support state and in the initial support state as seen along the fore and aft direction X, as in the case of the third contact portion 30*a*.

As shown in FIG. 4, the actuator device 10 includes an electric motor 35 connected to a support frame 34 which is connected to the wall 2, and a pinion gear 36 which is rotatable about an axis extending along the fore and aft direction X by the actuating action of the electric motor 35. The pinion gear 36 meshes with the rack 15 from above.

And the actuator device 10 is configured to rotate the pinion gear 36 by the actuating action of the electric motor 35 to move the rack 15 in the closing direction along the lateral direction Y to move the fire door 3 from the open position to the closed position. The operation of the actuator device 10 is controlled by a controller (not shown). And the controller controls the operation of the actuator device 10 based on detection information from a fire detecting device (not shown) for detecting a fire to move the fire door 3 from the open position to the closed position.

As shown in FIG. 4, the first connecting portion 28 is located at a height at which a gap G1 is formed along the vertical direction Z between the door main body 12 and the first connecting portion 28 in the expanded support state. In addition, the second connecting portion 32 is located at a height at which a gap G2 is formed along the vertical direction Z between the door main body 12 and the second connecting portion 32 in the expanded support state.

In addition, the upper frame portion 18 is formed such that the distance W1 along the fore and aft direction X between the first restricting portion 26 and the second restricting portion 27 is greater than the dimension, along the fore and aft direction, of the door main body 12 in the expanded form. Similarly, the lower frame portion 19 is formed such that the distance W2 along the fore and aft direction X between the third restricting portion 30 and the fourth restricting portion 31 is greater than the dimension, along the fore and aft direction, of the door main body 12 in the expanded form.

The length, along the vertical direction Z, of the door main body 12 in the initial support state (i.e., the length shown at L1 in FIG. 4) is less than the length, along the vertical direction Z, of the door main body 12 in the expanded support state (i.e., the length shown at L2 in FIG. 4); thus, also in the initial support state, a gap is formed along the vertical direction Z between the door main body 12 and the first connecting portion 28 and a gap is formed along the vertical direction Z between the door main body 12 and the second connecting portion 32.

In addition, in the initial support state, the dimension, along the fore and aft direction X, of the door main body 12 is less than the dimension in the expanded support state; thus, the distance, along the fore and aft direction X, between the first restricting portion 26 and the second restricting portion 27 is less than the dimension of the door main body 12 along the fore and aft direction X and the distance, along the fore and aft direction X, between the third restricting portion 30 and the fourth restricting portion 31 is less than the dimension of the door main body 12 along the fore and aft direction X.

Thus, in the initial support state, the door main body 12 does not contact the upper frame portion 18 or the lower frame portion 19 when the door body 8 is in the open position, in the closed position, and during the movement of the door body 8 from the open position to the closed position.

When the door main body 12 expands from the initial form to the expanded form due to heat from a fire, the distance along the vertical direction Z between the upper guide rollers 13 and the lower guide rollers 14 increases, causing the upper guide rollers 13 to be moved upwardly away from the upper frame portion 18 while the lower guide rollers 14 remain supported by the lower frame portion 19. When the upper guide rollers 13 are moved upwardly away from the upper frame portion 18, the upper guide rail 23 of the upper frame portion 18 no longer restricts movement of the upper guide rollers 13 along the fore and aft direction X. However, the first contact portion 26*a* of the first restricting portion 26 and the second contact portion 27*a* of the second restricting portion 27 still overlap with the upper end portion of the door main body 12 in the expanded support state as seen along the fore and aft direction X. Therefore, the movement of the upper end portion of the door main body 12 in the first direction X1 along the fore and aft direction X is restricted by virtue of the fact that the upper end portion of the door main body 12 comes into contact with the first contact portion 26*a* whereas the movement of the upper end portion of the door main body 12 in the second direction X2 along the fore and aft direction X is restricted by the virtue of the fact that the upper end portion of the door main body 12 comes into contact with the second contact portion 27*a*. Thus, movement of the door main body 12 itself along the fore and aft direction X is restricted in the upper portion of the door main body 12 by the restricting portion 22.

In addition, when the fire door 3 is in the expanded support state, the lower guide rollers 14 remain supported by the lower frame portion 19; thus, in the lower portion of the door main body 12, movements of the lower guide rollers 14 along the fore and aft direction X are restricted by the lower guide rail 24 of the lower frame portion 19.

In addition, after a fire breaks out, a heavy stream of water may be directed against the door body 8 in the fire fighting efforts to extinguish flames, with the door body 8 moved to the closed position. When this happens, the upper guide rollers 13 may be damaged when the door body 8 is pushed by the water pressure from the stream of water, etc. However, even if the upper guide rollers 13 have already been damaged when the door body 8 returns to the initial support state after the fire is extinguished, the first contact portion 26*a* of the first restricting portion 26 and the second contact portion 27*a* of the second restricting portion 27 overlap with the upper end portion of the door main body 12 as seen along the fore and aft direction X. Thus, movement of the door main body 12 itself along the fore and aft direction X is restricted in the upper portion of the door main body 12 by the restricting portion 22.

In addition, the lower guide rollers 14 remain supported by the lower frame portion 19 when the fire door 3 returns to the initial support state; thus, movements of the lower guide rollers 14 along the fore and aft direction X are restricted in the lower portion of the door main body 12 by the lower guide rail 24 of the lower frame portion 19.

In addition, after a fire breaks out, both the upper guide rollers 13 and lower guide rollers 14 may be damaged when the door body 8 is pushed by the water pressure, etc. from a heavy stream of water in the fire fighting efforts to extinguish flames, with the door body 8 moved to the closed position. When both the upper guide rollers 13 and the lower guide rollers 14 are damaged, the door body 8 is prevented from coming off and falling from the guide member 9 by virtue of the fact that the door main body 12 is supported by the second connecting portion 32 of the lower frame portion 19.

In addition, with the door main body 12 returned to the initial form and with the door main body 12 supported by the second connecting portion 32, the first contact portion 26*a* and the second contact portion 27*a* overlap with the upper end portion of the door main body 12 as seen along the fore and aft direction X. Thus, movement of the door main body 12 itself along the fore and aft direction X is restricted in the upper portion of the door main body 12 by the restricting portion 22. In addition, the third contact portion 30*a* and the fourth contact portion 31*a* overlap with the lower end portion of the door main body 12 as seen along the fore and aft direction X. Thus, movement of the door main body 12 itself along the fore and aft direction X is restricted in the lower portion of the door main body 12 by the restricting portion 22.

Thus, even if the door main body 12 expands due to heat from a fire, the upper guide rollers 13 and the lower guide rollers 14 as well as the upper frame portion 18 and the lower frame portion 19 can be prevented from being damaged before the actual damage occurs. Furthermore, any reduction in strength of the door main body 12 with the door body 8 moved to the closed position can be alleviated.

[Alternative Embodiments]

(1) In the embodiment described above, the door body 8 is so dimensioned that the first restricting portion 26 and the second restricting portion 27 overlap with the upper end portion of the door main body 12 as seen along the fore and aft direction X in both the expanded support state and the initial support state. However, the door body 8 is not limited to such an arrangement. For example, the door body 8 may be so dimensioned that the first restricting portion 26 and the second restricting portion 27 overlap with the upper end portion of the door main body 12 as seen along the fore and aft direction X in the expanded support state and such that the first restricting portion 26 and the second restricting portion 27 do not overlap with the upper end portion of the door main body 12 as seen along the fore and aft direction X in the initial support state.

(2) In the embodiment described above, an upper portion of the first restricting portion 26 and an upper portion of the second restricting portion 27 are connected to each other by the first connecting portion 28. However, one lateral end, along the lateral direction Y, of the first restricting portion 26 and one lateral end, along the lateral direction Y, of the second restricting portion 27 may be connected to each other by the first connecting portion 28. Also, in the embodiment described above, a lower portion of the third restricting portion 30 and a lower portion of the fourth restricting portion 31 are connected to each other by the second connecting portion 32. However, one lateral end, along the lateral direction Y, of the third restricting portion 30 and one lateral end, along the lateral direction Y, of the fourth restricting portion 31 may be connected to each other by the second connecting portion 32.

In addition, in the embodiment described above, the upper frame portion 18 is formed by connecting together the first restricting portion 26, the second restricting portion 27, and the first connecting portion 28 which are respectively formed as separate portions. However, the upper frame portion 18 may be formed by the first restricting portion 26, the second restricting portion 27, and the first connecting portion 28 that are integrally formed together.

Also, in the embodiment described above, the lower frame portion 19 is formed by connecting together the third restricting portion 30, the fourth restricting portion 31, and the second connecting portion 32 which are respectively formed as separate portions. However, the lower frame portion 19 may be formed by the third restricting portion 30, the fourth restricting portion 31, and the second connecting portion 32 that are integrally formed together.

(3) In the embodiment described above, the upper guided portion includes the upper guide rollers 13 each of which rolls on the top surface of the upper guide portion. However, the upper guide portion may include a plurality of rollers arranged along the lateral direction Y. And the upper guided portion may be a rail member which moves on the upper guide portion. In addition, the upper guided portion may include one or more slide members which slide on the top surface of the upper guide portion.

Also, the lower guided portions are the lower guide rollers 14 each of which rolls on the top surface of the lower guide portion. However, the lower guide portion may have a plurality of rollers arranged along the lateral direction Y. And the lower guided portion may be a rail member which moves on the lower guide portion. In addition, the lower guided portion may be one or more slide members which slide on the top surface of the lower guide portion.

(4) In the embodiment described above, the opening 1 is used as an opening which the ceiling transport vehicle 4 travels through. However, how the opening 1 is used can be changed suitably. For example, the opening 1 may be used to allow a worker to walk through, or used for ventilation purposes.

[Summary of Embodiments Described Above]

A brief summary of the fire door described above is provided next.

The characteristic arrangement of a fire door is that the fire door comprises: a plate-shaped door body movable from an open position at which an opening is open to a closed position at which the opening is closed by the door body; a guide member for guiding movement of the door body; wherein the door body is disposed in an attitude in which the door body extends along a vertical direction of the opening and along a lateral direction of the opening, the door body being movable along the lateral direction from the open position to the closed position, wherein, with a direction perpendicular to the lateral direction as seen along the vertical direction being defined as a fore and aft direction, the door body includes a door main body, an upper guided portion provided to an upper portion of the door main body, and a lower guided portion provided to a lower portion of the door main body; wherein the guide member includes an upper guide portion for guiding the upper guided portion along the lateral direction, a lower guide portion for guiding the lower guided portion along the lateral direction, and a restricting portion for restricting movement of the door main body along the fore and aft direction, wherein the upper guide portion supports the upper guided portion from below while restricting movement of the upper guided portion along the fore and aft direction, wherein the lower guide portion supports the lower guided portion from below while restricting movement of the lower guided portion along the fore and aft direction, wherein the door body is so dimensioned that the upper guided portion is moved upwardly away from the upper guide portion when in an expanded support state in which the lower guide portion is supporting the lower guided portion from below and in which the door main body has expanded from an initial form due to heat from a fire, wherein the restricting portion includes a first restricting portion and a second restricting portion, wherein, with one direction along the fore and aft direction being defined as a first direction and a direction along the fore and aft direction that is opposite from the first direction being defined as a second direction, the first restricting portion includes a first contact portion which overlaps with an upper end portion of the door main body as seen along the fore and aft direction when in the expanded support state, wherein, when in the expanded support state, the first contact portion restricts movement of the door main body in the first direction by coming into contact with a surface of the upper end portion of the door main body that faces in the first direction, wherein the second restricting portion includes a second contact portion which overlaps with an upper end portion of the door main body as seen along the fore and aft direction when in the expanded support state, and wherein, when in the expanded support state, the second contact portion restricts movement of the door main body in the second direction by coming into contact with a surface of the upper end portion of the door main body that faces in the second direction.

As such, when moving the door body along the lateral direction to move it from the open position to the closed position, both the upper portion and the lower portion of the door main body can be guided by the upper guided portion provided to the upper portion of the door main body and the lower guided portion provided to the lower portion of the door main body, thus allowing the door main body to be moved smoothly.

When the door main body expands from the initial form due to heat from a fire, the distance along the vertical direction between the upper guided portion and the lower guided portion increases due to this thermal expansion. When this happens, because the upper guided portion is moved upwardly away from the upper guide portion while the lower guided portion remains supported from below by the lower guide portion, stress is prevented from concentrating on the upper guided portion and the lower guided portion, thus, preventing the upper guided portion and/or the lower guided portion from being damaged.

In addition, although the upper guided portion is moved upwardly away from the upper guide portion in the expanded support state, movement of the upper end portion of the door main body in the first direction along the fore and aft direction can be restricted by the first contact portion of the first restricting portion of the restricting portion whereas movement of the upper end portion of the door main body in the second direction along the fore and aft direction can be restricted by the second contact portion of the second restricting portion of the restricting portion.

In other words, in the expanded support state, and in the lower portion of the door main body, movement of the lower guided portion along the fore and aft direction can be restricted by the lower guide portion while supporting the lower guided portion from below, whereas, in the upper portion of the door main body, movement of the door main body itself along the fore and aft direction can be restricted by the restricting portion. Therefore, damage to the door body caused by the door body expanding due to heat from a fire can be prevented. And reduction in strength of the door body can be alleviated by restricting movement of the door body along the fore and aft direction.

Here, the restricting portion preferably includes a connecting portion which is located above the door main body and which connects the first restricting portion and the second restricting portion to each other, wherein the connecting portion is preferably located at such a height that a gap is formed, along the vertical direction, between the door main body and the connecting portion in the expanded support state.

That is, the restricting portion can be strengthened by connecting the first restricting portion and the second restricting portion to each other by the connecting portion. And although the connecting portion is located above the door main body, a vertical gap is formed between the door main body and the connecting portion even in the expanded support state; so, damages to the door main body and/or to the restricting portion, due to the door main body coming into contact with the connecting portion as the fire door transitions into the expanded support state, can be avoided.

In addition, the first restricting portion and the second restricting portion are preferably so located to overlap with an upper end portion of the door main body as seen along the fore and aft direction, both in the expanded support state and in an initial support state in which the lower guide portion is supporting the lower guided portion from below and in which the door main body is in the initial form.

That is, the first restricting portion and the second restricting portion are located at positions in which they overlap with an upper end portion of the door main body in both the expanded support state and the initial support state, as seen along the fore and aft direction. Thus, in the upper portion of a door main body, movement of the door main body itself along the fore and aft direction is restricted by the restricting portion also in an initial support state.

That is, after a fire breaks out, the upper guide portion may be damaged by the fire or by the water pressure, etc. from a heavy stream of water in the firefighting efforts to extinguish flames. However, in accordance with the present arrangement, even when the upper guided portion is damaged when the door body returns to its initial support state after the fire is extinguished, movement of the door main body itself along the fore and aft direction can be restricted by the restricting portion, in the upper portion of the door main body.

In addition, the restricting portion preferably includes a third restricting portion, a fourth restricting portion, and a second connecting portion, wherein the third restricting portion preferably includes a third contact portion which overlaps with a lower end portion of the door main body as seen along the fore and aft direction when in the expanded support state, wherein, when in the expanded support state, the third contact portion preferably restricts movement of the door main body in the first direction by coming into contact with a surface of the lower end portion of the door main body that faces in the first direction, wherein the fourth restricting portion preferably includes a fourth contact portion which overlaps with an lower end portion of the door main body as seen along the fore and aft direction when in the expanded support state, wherein, when in the expanded support state, the fourth contact portion preferably restricts movement of the door main body in the second direction by coming into contact with a surface of the lower end portion of the door main body that faces in the second direction, wherein the second connecting portion is preferably located below the door main body and connects the third restricting portion and the fourth restricting portion to each other, and wherein a position of the second connecting portion along the vertical direction is preferably such a position that a gap is formed, along the vertical direction, between the door main body and the second connecting portion, when in an initial support state in which the lower guide portion is supporting the lower guided portion from below and in which the door main body is in the initial form.

That is, the restricting portion can be strengthened by connecting the third restricting portion and the fourth restricting portion to each other by the second connecting portion. And although the second connecting portion is located below the door main body, a vertical gap is formed between the door main body and the second connecting portion even in the expanded support state; so, damages to the door main body and/or to the restricting portion, due to the door main body coming into contact with the second connecting portion as the fire door transitions into the expanded support state, can be avoided.

In addition, each of the upper guided portion and the lower guided portion preferably includes one or more guide rollers, each of which rotates about an axis that extends along the fore and aft direction.

That is, the door body can be smoothly guided along the lateral direction by the rotations of one or more guide rollers that function as the upper guided portion and the lower guided portion. In addition, as the door body transitions into the expanded support state, the upper guided portion is moved upwardly away from the upper guide portion. Thus, damages to the upper guided portion and/to the lower guided portion can be avoided in contrast to, for example, a case in which the upper guided portion and the lower guided portion are arranged such that they can move along the lateral direction by engaging respective straight guide portions extending along the lateral direction but such that their vertical movements are restricted.

Also, the opening is preferably formed in a wall for dividing an area into a plurality of areas, wherein a ceiling transport vehicle is preferably provided which travels through the opening to travel between the plurality of areas.

That is, in a case in which a ceiling transport vehicle is arranged to travel, through the opening formed in a wall, between a plurality of areas divided by the wall, flames, smoke, and hot air generated in one area can be prevented from moving through the opening and into the area on the other side of the wall by closing the opening with the fire door.

What is claimed is:

1. A fire door comprising:

a plate-shaped door body movable from an open position at which an opening is open to a closed position at which the opening is closed by the door body;

a guide member for guiding movement of the door body;

wherein the door body is disposed in an attitude in which the door body extends along a vertical direction of the opening and along a lateral direction of the opening, the door body being movable along the lateral direction from the open position to the closed position, wherein, with a direction perpendicular to the lateral direction as seen along the vertical direction being defined as a fore and aft direction, wherein the door body includes a door main body, an upper guided portion provided to an upper portion of the door main body, and a lower guided portion provided to a lower portion of the door main body, wherein the guide member includes an upper guide portion for guiding the upper guided portion along the lateral direction, a lower guide portion for guiding the lower guided portion along the lateral direction, and a restricting portion for restricting movement of the door main body along the fore and aft direction, wherein the upper guide portion supports the upper guided portion from below while restricting movement of the upper guided portion along the fore and aft direction, wherein the lower guide portion supports the lower guided portion from below while restricting movement of the lower guided portion along the fore and aft direction, wherein the door body is so dimensioned that the upper guided portion is moved upwardly away from the upper guide portion when in an expanded support state in which the lower guide portion is supporting the lower guided portion from below and in which the door main body has expanded from an initial form due to heat from a fire, wherein the restricting portion includes a first restricting portion and a second restricting portion, wherein, with one direction along the fore and aft direction being defined as a first direction and a direction along the fore and aft direction that is opposite from the first direction being defined as a second direction, wherein the first restricting portion includes a first contact portion which overlaps with an upper end portion of the door main body as seen along the fore and aft direction when in the expanded support state, wherein, when in the expanded support state, the first contact portion restricts movement of the door main body in the first direction by coming into contact with a surface of the upper end portion of the door main body that faces in the first direction, wherein the second restricting portion includes a second contact portion which overlaps with an upper end portion of the door main body as seen along the fore and aft direction when in the expanded support state, and wherein, when in the expanded support state, the second contact portion restricts movement of the door main body in the second direction by coming into contact with a surface of the upper end portion of the door main body that faces in the second direction.

2. The fire door as defined in claim 1, wherein the restricting portion includes a connecting portion which is located above the door main body and which connects the first restricting portion and the second restricting portion to each other, and wherein the connecting portion is located at such a height that a gap is formed, along the vertical direction, between the door main body and the connecting portion in the expanded support state.

3. The fire door as defined in claim 1, wherein the first restricting portion and the second restricting portion are so located to overlap with an upper end portion of the door main body as seen along the fore and aft direction, both in the expanded support state and in an initial support state in which the lower guide portion is supporting the lower guided portion from below and in which the door main body is in the initial form.

4. The fire door as defined in claim 1, wherein the restricting portion includes a third restricting portion, a fourth restricting portion, and a second connecting portion, wherein the third restricting portion includes a third contact portion which overlaps with a lower end portion of the door main body as seen along the fore and aft direction when in the expanded support state, wherein, when in the expanded support state, the third contact portion restricts movement of the door main body in the first direction by coming into contact with a surface of the lower end portion of the door main body that faces in the first direction, wherein the fourth restricting portion includes a fourth contact portion which overlaps with an lower end portion of the door main body as seen along the fore and aft direction when in the expanded support state, wherein, when in the expanded support state, the fourth contact portion restricts movement of the door main body in the second direction by coming into contact with a surface of the lower end portion of the door main body that faces in the second direction, wherein the second connecting portion is located below the door main body and connects the third restricting portion and the fourth restricting portion to each other, and wherein a position of the second connecting portion along the vertical direction is such a position that a gap is formed, along the vertical direction, between the door main body and the second connecting portion, when in an initial support state in which the lower guide portion is supporting the lower guided portion from below and in which the door main body is in the initial form.

5. The fire door as defined in claim 1, wherein each of the upper guided portion and the lower guided portion includes one or more guide rollers, each of which rotates about an axis that extends along the fore and aft direction.

6. The fire door as defined in claim 1, wherein the opening is formed in a wall for dividing an area into a plurality of areas, and wherein a ceiling transport vehicle is provided which travels through the opening to travel between the plurality of areas.

* * * * *